US005895154A

United States Patent [19]

Acquaviva et al.

[11] Patent Number: 5,895,154

[45] Date of Patent: Apr. 20, 1999

[54] TEXTURED ROLLERS FOR PAPER CONDITIONING

[75] Inventors: Thomas Acquaviva, Penfield; Rabin Moser, Victor, both of N.Y.

[73] Assignee: Xerox Corporation, Stamford, Conn.

[21] Appl. No.: 09/094,881

[22] Filed: Jun. 15, 1998

[51] Int. Cl.[6] ..... G03G 15/20; G03G 15/00

[52] U.S. Cl. ..... 399/341; 399/406; 399/407

[58] Field of Search ..... 399/341, 342, 399/407, 406

[56] References Cited

U.S. PATENT DOCUMENTS 5,264,899 11/1993 Mandel ..... 399/341

5,434,029 7/1995 Moser ..... 399/328 X 5,850,589 12/1998 Cruz et al. ..... 399/341

*Primary Examiner*—S. Lee

*Attorney, Agent, or Firm*—William A. Henry, II

[57] ABSTRACT

A paper conditioner re-moisturizes paper immediately following fusing to restore paper moisture equilibrium and reduce curl. The paper conditioner uses moisturizing rollers with a textured elastomeric surface that prevents bead buildup of water at a nip formed between the moisturizing rollers and allows the rollers to conform to the surface texture of a sheet of paper passing therethrough.

12 Claims, 2 Drawing Sheets

TEXTURED ROLLERS FOR PAPER CONDITIONING

CROSS-REFERENCE TO RELATED APPLICATIONS

Cross-reference is hereby made to copending and commonly assigned U.S. application Ser. No. 08/939,896, filed Sep. 29, 1997, and entitled Paper Conditioning System by Thomas Acquaviva.

BACKGROUND OF THE INVENTION

1. Field of the Invention

This invention relates generally to a substrate conditioning system for an electrophotographic printing machine and, more particularly, concerns textured rollers for applying moisture to cut sheets or web material in a monocolor or full color process printing machine.

2. Description of the Prior Art

In typical multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling.

Paper curl is defined as any deviation from it's flat state. In the xerographic process, fusing drives moisture out. When regaining moisture from the environment, paper experiences curl due to differential hygroexpansitivity and thermalexpansitivity, between the paper and toner, as well as, the dimensional instability of paper due to it's moisture history. The paper expands due to moisture reabsorption, but the toner does not expand, thus developing curl. Paper curl is one of the primary pauses for paper handling problems in copying machines. Problems, such as, stubbing, image deletions and improper stacking result from copy sheet curl. These problems are more severe for color copies than black and white due to differences in their toner mass area, substrates, and fuser characteristics.

The following disclosures may be relevant to various aspects of the present invention:

U.S. Pat. No. 5,264,899

Patentee: Mandel

Issued: Nov. 23, 1993

U.S. Pat. No. 5,434,029

Inventor: Moser

Issue Date: Jul. 18, 1995

Portions of the foregoing disclosures may be briefly summarized as follows:

U.S. Pat. No. 5,264,899 describes a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the copy sheet as it is passed through the nip. The added moisture prevents edge wave formation.

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

A major problem is presented when paper conditioners with smooth moisturizing rollers are used to re-moisturize paper. With smooth moisturizing rollers, fluid would not be able to penetrate a nip formed between a smooth moisturizing roller and a backup roller and would form a bead at the nip entrance. A sheet entering a nip would be wet only on the lead edge and the remaining portion of the sheet would be starved of fluid. Thus, there remains a need for a system which re-moisturizes paper immediately following fusing to restore paper moisture equilibrium and reduce curl.

SUMMARY OF THE INVENTION

Accordingly, an apparatus for re-moisturizing sheets immediately after fusing to rapidly bring the sheets to moisture equilibrium is disclosed that comprises: a pair of generally cylindrical moisturizing rolls, each having a textured outer cylindrical surface, said moisturizing rolls being aligned with respect to one another along their axes so as to define a nip between said outer cylindrical surfaces when a sheet is present therebetween; a plurality of donor rolls with one each of said plurality of donor rolls being in contact with each of said pair of moisturizing rolls; a pair of metering rolls positioned in circumferential surface contact with a pair of said plurality of said donor rolls for supplying liquid from a sump to said pair of moisturizing rolls; and a pair of metering blades with one each of said pair of metering blades being positioned against said outer cylindrical surface of one each of said pair of moisturizing rolls to remove excess liquid from said outer cylindrical surface of said moisturizing rolls.

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
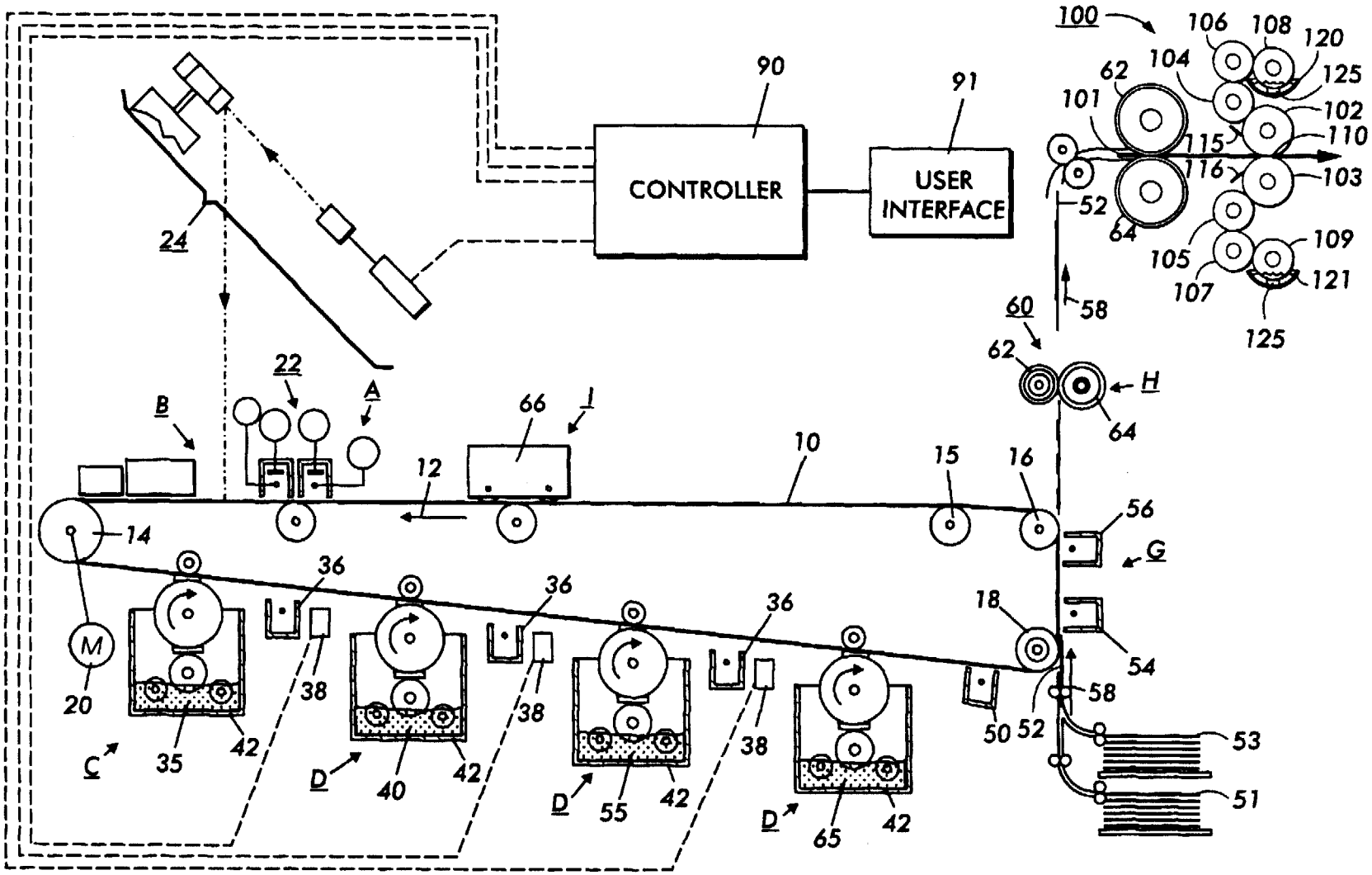
FIG. 1 is a schematic elevational view of a full color image-on-image single pass electrophotographic printing machine utilizing the sheet conditioning device described herein.

Turning now in general to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension roller 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C which contains black toner 35, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles 35 (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager for a third suitable color toner 55, such as, magenta and for a fourth imager and suitable color toner 65, such as, cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets in trays. The feed rolls rotate so as to advance the uppermost sheet from stack into a chute which directs the advancing sheet of support material into contact with photoconductive surface of belt in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to sheet moisture replacement system 100 and then to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
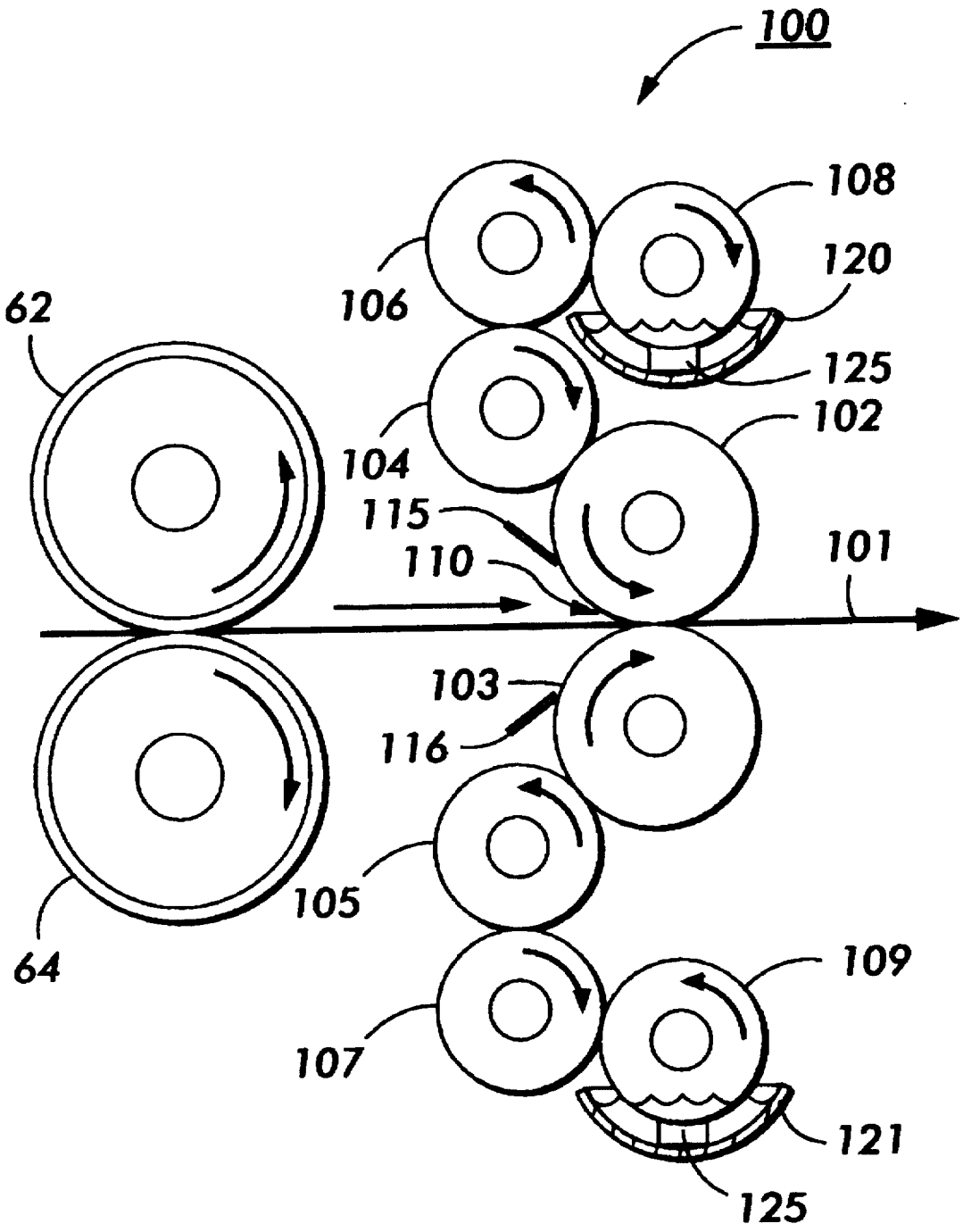
FIG. 2 is a schematic side view of the sheet conditioning device of FIG. 1.

As shown in FIG. 2, the sheet conditioning device, generally referred to as reference numeral 100, has hydrophilic moisturizing rollers 102, 103 which are rotated in a counter clockwise direction for 102 and a clockwise direction for 103 to receive the lead edge of incoming sheets 52 into the nip area 110.

The conditioning agent, in this case mostly water to which a surfactant can be added, is distributed to the moisturizing roll 102 from trough 120 and moisturizing 103 roll from trough 121, by way of metering rolls 108, 109. Troughs 120 and 121 each include a high density, wick 125 to transfer a conditioning agent from supply trough 120 and 121 to metering rolls 108 and 109. The material of wick 125 can be cotton, wool, or Nomex. Nomex is preferred because of its non-interaction with the conditioning agent. The conditioning agent is applied onto the metering roll 108 and then transfers to donor rolls 106, 104 and donor rolls 107 and 105 from metering roll 109 and then to moisturizing rolls 102 and 103. Simply emersing part of each metering roll in a trough of water will not sufficiently wet it's surface. The agent does not stick to the rotating metering roll surface. Thus, high density wick 125 is added to each sump. The wick is kept in close contact with the metering roll. The amount of moisture added to a sheet is a function of the pressure between the sheet 52 and the moisturizing rolls 102, 103. The direction of the sheet is indicated by arrow 101.

Moisturizing rolls 102 and 103 have a textured elastomeric surface in order to hold a sufficient amount of conditioning agent to moisturize a sheet. The textured elastomeric surfaces permit conditioning agent to enter the moisturizing nip and allow the rollers to conform to the surface texture of the sheet. The texture of moisturizing rolls 102 and 103 serves three purposes. First, it retains a supply of conditioning agent in the depression pockets. Second, it provides a path for the conditioning agent to enter the nip. Without a texture, the conditioning agent would not be able to penetrate the nip and would form a bead at the entrance. A sheet entering the nip would be wet only on the lead edge and the remaining portion of the sheet would be starved of conditioning agent. Third, the textured elastomer conforms to the sheet surface in the high pressure nip and forces the conditioning fluid into the sheet where the sheet fibers are allowed to swell. Analysis and experiments indicate that the texture of the moisturizing rollers, as well as, the metering rollers must be in the order of 100–500 microinches. The durometer of the moisturizing rollers is preferably in the order of 30–60 Shore A. Excess conditioning agent applied to the moisturizing rolls must be removed. If left on the surface of the moisturizing rolls, it cannot penetrate the moisturizing nip 110 and will form a bead at the nip input. When a sheet enters, the agent will overmoisturize the lead edge resulting in excessive lead edge curl. Hence, metering blades 115 and 116 are included adjacent the outer cylindrical surface of moisturizing rolls 102 and 103, respectively. With blades 115 and 116 pressing against moisturizing rolls 102 and 103, respectively, beads of conditioning agent do not form at the nip entrance. Preferably, each blade is backed up by a piece of shim stock, for example, a 0.025" piece of plastic to give some rigidity to the blades. The blades are preferably 0.110" thick×20 mm wide and positioned at an angle of approximately 45° with respect to a horizontal plane through the center of each of the moisturizing rolls. The blades are shown as wiper blades, but they may also operate as doctor blades.

In recapitulation, a paper conditioner adds a small amount of water to sheets in order to control sheet curl. The paper conditioner employs nip forming moisturizing rollers with each roller having a textured elastomeric surface that provides a path for the water to go through the roller nip. This avoids formation of a bead of water at the entrance of the nip and also gets the water into the nip so it can be pushed into the paper when the paper is in the nip.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for re-moisturizing sheets immediately after fusing to rapidly bring the sheets to moisture equilibrium, comprising:

a pair of sumps for storing a quantity of liquid;

a pair of generally cylindrical moisturizing rolls, each having a textured outer cylindrical surface, said moisturizing rolls being aligned with respect to one another along their axes so as to define a nip between said outer cylindrical surfaces when a sheet is present therebetween;

a plurality of donor rolls with one each of said plurality of donor rolls being in contact with each of said pair of moisturizing rolls; and a pair of metering rolls positioned in circumferential surface contact with a pair of said plurality of said donor rolls for supplying liquid from said pair of sumps to said pair of moisturizing rolls.

2. The apparatus of claim 1, including a pair of wiper blades with one each of said pair of wiper blades being positioned against said outer cylindrical surface of one each of said pair of moisturizing rolls to remove excess liquid from said outer cylindrical surface of said moisturizing rolls.

3. The apparatus of claim 2, wherein said wiper blades are positioned on said outer cylindrical surfaces of said moisturizing rolls at a 45° angle with respect to a horizontal plane through each of said moisturizing rolls.

4. The apparatus of claim 1, wherein one of said moisturizing rolls rotates in a counter clockwise direction.

5. The apparatus of claim 1, wherein one of said metering rolls rotates in a clockwise direction.

6. The apparatus of claim 5, wherein said moisturizing rolls are hydrophilic.

7. The apparatus of claim 6, wherein said plurality of donor rolls comprise two pairs of rolls.

8. A system for fixing a toner image to a copy sheet in an electrophotographic system to avoid copy sheet curl, comprising:

first and second fusing rollers defining a nip therebetween, at least one of said fusing rollers being heated, wherein the fusing rollers serve to fix a toner image on a copy sheet through applying heat and pressure to the copy sheet; and a conditioning system for receiving a copy sheet from said fusing rollers, comprising; a pair of moisturizing rolls that form a nip when a sheet passes therethrough;

a pair of metering rolls for supplying a conditioning agent to said moisturizing rolls;

a pair of sumps for holding a quantity of conditioning agent, each of said metering rolls being positioned with a portion thereof within one each of said sumps for picking up conditioning agent from said sumps; and a series of donor rolls, said donor rolls being configured to transfer conditioning agent from said sumps to said moisturizing rolls.

9. The system of claim 8, wherein one of said moisturizing rolls rotates in a counter clockwise direction.

10. The system of claim 9, wherein one of said metering rolls rotates in a clockwise direction.

11. The system of claim 10, wherein said moisturizing rolls are hydrophilic.

12. The system of claim 11, wherein said series of donor rolls comprise two pairs of rolls.

* * * * *